US011519220B2

(12) United States Patent
Benotto

(10) Patent No.: US 11,519,220 B2
(45) Date of Patent: Dec. 6, 2022

(54) CURTAIN OF A VERTICAL SLIDING ROLL-UP DOOR, PROVIDED WITH A LATERAL AIR SEAL

(71) Applicant: B.PROJET S.r.l., Vezza d'Alba (IT)

(72) Inventor: Danilo Benotto, Vezza d'Alba (IT)

(73) Assignee: B.PROJET S.R.L.

( * ) Notice: Subject to any disclaimer, the term of this patent is extended or adjusted under 35 U.S.C. 154(b) by 0 days.

(21) Appl. No.: 17/213,159

(22) Filed: Mar. 25, 2021

(65) Prior Publication Data

US 2021/0301590 A1 Sep. 30, 2021

(30) Foreign Application Priority Data

Mar. 27, 2020 (IT) ..... 102020000006523

(51) Int. Cl.
*E06B 9/17* (2006.01)
*E06B 9/42* (2006.01)
*E06B 9/58* (2006.01)

(52) U.S. Cl.
CPC ..... *E06B 9/17076* (2013.01); *E06B 9/42* (2013.01); *E06B 9/58* (2013.01)

(58) Field of Classification Search
CPC ..... E06B 9/17076; E06B 9/13; E06B 9/17; E06B 9/42; E06B 9/58
USPC ..... 160/120, 273.1
See application file for complete search history.

(56) References Cited

U.S. PATENT DOCUMENTS

| | | | | |
|---|---|---|---|---|
| 7,025,105 | B2 * | 4/2006 | Lancina | E06B 9/17076 160/41 |
| 7,516,770 | B2 * | 4/2009 | Jerry | E06B 9/13 160/267.1 |
| 8,109,317 | B2 * | 2/2012 | Bostyn | E06B 9/581 160/271 |
| 8,851,147 | B2 * | 10/2014 | Drifka | E06B 9/13 160/273.1 |
| 9,429,353 | B2 * | 8/2016 | Schumacher | F25D 13/00 |
| 9,493,984 | B2 * | 11/2016 | Casey | E06B 9/581 |
| 9,637,972 | B2 * | 5/2017 | Miller | E06B 9/58 |
| 10,260,279 | B2 * | 4/2019 | Nakae | E06B 9/40 |
| 2005/0016695 | A1 * | 1/2005 | Thompson | E06B 9/581 160/268.1 |
| 2009/0229767 | A1 * | 9/2009 | Mullet | E06B 9/581 160/26 |
| 2011/0067307 | A1 * | 3/2011 | Dondlinger | E06B 9/56 49/350 |
| 2012/0012262 | A1 * | 1/2012 | Santoro | E06B 9/582 160/271 |
| 2013/0061525 | A1 * | 3/2013 | Drifka | E06B 9/582 49/501 |
| 2013/0306252 | A1 * | 11/2013 | Lambridis | E06B 9/582 160/133 |
| 2015/0292262 | A1 * | 10/2015 | Miller | E06B 9/13 160/270 |

* cited by examiner

*Primary Examiner* — Beth A Stephan
(74) *Attorney, Agent, or Firm* — Hayes Soloway P.C.

(57) ABSTRACT

A vertically sliding roll-up door has a portal structure including vertical uprights provided with guide rails for guiding the sliding of blocks fixed along the lateral edges of the curtain, to allow the curtain to move vertically with respect to the portal structure. The curtain includes air-sealing gaskets which extend substantially over the entire length of the longitudinal edges of the curtain at the blocks, in order to block the passage of air between the guide rails and the blocks.

19 Claims, 2 Drawing Sheets

CURTAIN OF A VERTICAL SLIDING ROLL-UP DOOR, PROVIDED WITH A LATERAL AIR SEAL

TECHNICAL FIELD

The present invention relates in general to vertical sliding industrial doors, particularly of the quick-slide type, that is, in which opening and closing take place at a relatively high speed.

More particularly, the invention relates to the curtain of a vertical sliding roll-up door, which door comprises a portal structure including vertical uprights provided with guide rails for guiding the sliding of blocks fixed along the lateral edges of the curtain, in order to allow the curtain to move vertically with respect to the portal structure.

BACKGROUND OF THE INVENTION

These known doors comprise a portal structure including an upper cross-member and a pair of parallel vertical uprights, which structure delimits, together with a lower base plane, a wall opening having a generally rectangular shape. This opening can be closed by means of a vertically movable flexible curtain, usually made of plastic material such as PVC, polyethylene or polyurethane, or of a plasticized textile material, which has a thickness of the order of millimeter or a few millimeters.

In the raised configuration of the curtain, which corresponds to the open condition of the door, the curtain is wound in a shelter area placed above the upper cross-member of the portal structure, typically about a horizontal motorized winding shaft that extends in said shelter area, or arranged in the shelter area according to a spiral configuration as a result of the engagement of the lateral edges thereof in spiral grooves formed in a pair of symmetrical and opposed panels arranged at the opposite ends of the shelter area.

The lateral edges of the curtain are provided with respective continuous series of blocks having a thickness greater than the curtain, usually of the order of centimeter, so as to project from the plane of the curtain. These blocks, which have a configuration similar to the teeth of a half-part of a zip fastener, slidably engage the guide rails associated with the vertical uprights of the portal structure.

With reference to FIGS. 2 and 3 of the drawings, which show details of a curtain of a roll-up door according to the prior art, each lateral edge of the curtain 20 comprises blocks 26 fixed to a flexible longitudinal strip 24 typically made of textile material, such as a fabric of polyamide yarns, on which a relative lateral edge of the curtain 20 is in turn fixed by sewing or welding.

The blocks 26 engage the longitudinal cavity 23 of a respective guide rail 22 to allow the curtain 20 to slide with respect to the guide rails 22 and the uprights of the portal structure. In order for the edges of the curtain 20 to slide with respect to the guide rails 22, there must be at least a small clearance between the blocks 26 and the inner cavity 23 of the rails 22, so as to avoid the occurrence of friction which could slow the sliding of the curtain 20.

Owing to the presence of this clearance, however, if there is a pressure difference between the upstream and downstream environments of the curtain, as is commonly the case, and when the curtain 20 is in the lowered configuration in which the opening defined by the portal structure is closed, a passage of air takes place between such environments, which happens through the clearance between the blocks 26 and the cavity 23 of the rails 22, as schematically indicated by arrows B and C of FIG. 3. This passage of air gives rise to drafts at the lateral edges of the curtain 20, which do not allow the environments located upstream and downstream of the curtain 20 to be thermally isolated in an effective manner.

OBJECT AND SUMMARY OF THE INVENTION

The main object of the present invention is to provide an improved vertical sliding roll-up door having sealing means for lateral sealing the air in order to obtain a better insulation of the environments upstream and downstream of the curtain, particularly to favor the thermal insulation of such environments.

This object is achieved by virtue of the fact that the curtain comprises air-sealing gaskets that extend substantially over the entire length of the longitudinal edges of the curtain at said blocks, in order to block the passage of air between the guide rails and said blocks.

According to a preferred feature of the invention, the curtain comprises said gaskets on both sides of each lateral edge of the curtain.

In this manner, the seals on both sides of the curtain allow to avoid even more effectively a passage of air between the guide rails and said blocks.

According to another preferred feature of the invention, the gaskets have a first portion fixed to a respective edge of the curtain, or to a strip for fixing it to the curtain, and a second portion that projects from the plane of the curtain, which is intended to rest slidably on an outer surface of the respective guide rail.

In this manner, the second portion of the lateral gaskets of the curtain, which rests on an outer surface of the respective guide rail, allows the passage of air to be effectively contrasted through the clearance between the lateral blocks of the curtain and the cavity of the guide rails.

According to yet another preferred feature, the gaskets are made in a flat form by means of an elastic material, so that the second portion, in its configuration of use resting on an outer surface of the respective guide rail, assumes a deformed shape with respect to the flat shape, such as to give rise to an elastic return force which keeps the second portion adherent to the relative guide rail.

According to a first modification of the invention, the second portion of each gasket has a laminar shape. This makes it possible to make the gaskets in a simple and cost-effective manner, while allowing an effective air seal to be obtained.

According to another modification of the invention, the end of said second portion of each gasket is thicker than the first portion.

In this manner, the end of the second portion of each gasket opposite the first end, which is more subject to deformation cycles owing to the movement of the curtain, is more sturdy and resistant.

According to yet another preferred feature, the second portion of each gasket has a tubular shape.

In this manner, the second portion of the gaskets is easily deformable under pressure, so that it can better adapt to the contact with the aforesaid outer surface of the respective guide rail.

BRIEF DESCRIPTION OF THE DRAWING

Further characteristics and advantages of the invention will become clearer from the following detailed description, given by way of non-limiting example and referred to the attached drawings, in which.

DETAILED DESCRIPTION OF THE INVENTION

Figure 2:
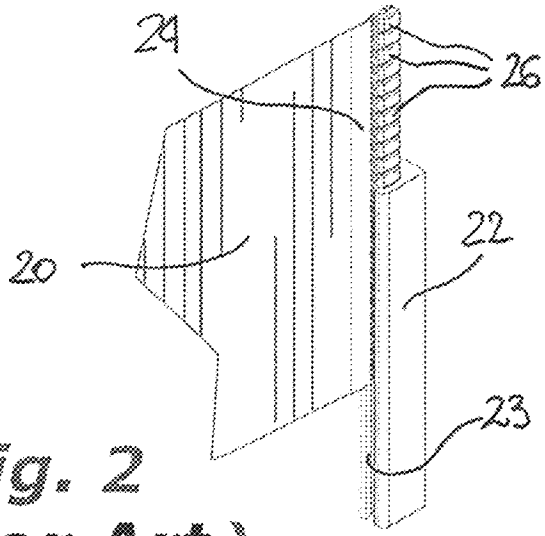
Fig. 2 (Prior Art)
FIG. 2 is a schematic perspective view of a guide rail associated with an upright of the door of FIG. 1, the cavity of which is slidably engaged by blocks fixed to a lateral edge of the curtain according to the prior art.
Figure 3:
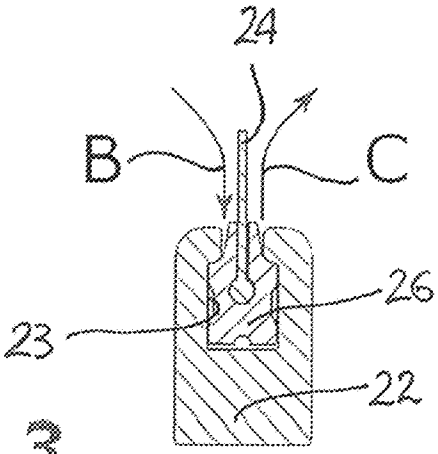
Fig. 3 (Prior Art)
FIG. 3 is a cross-sectioned elevational view of the guide rail of FIG. 2 and of a block fixed to the lateral edge of the curtain according to the prior art.
Figure 1:
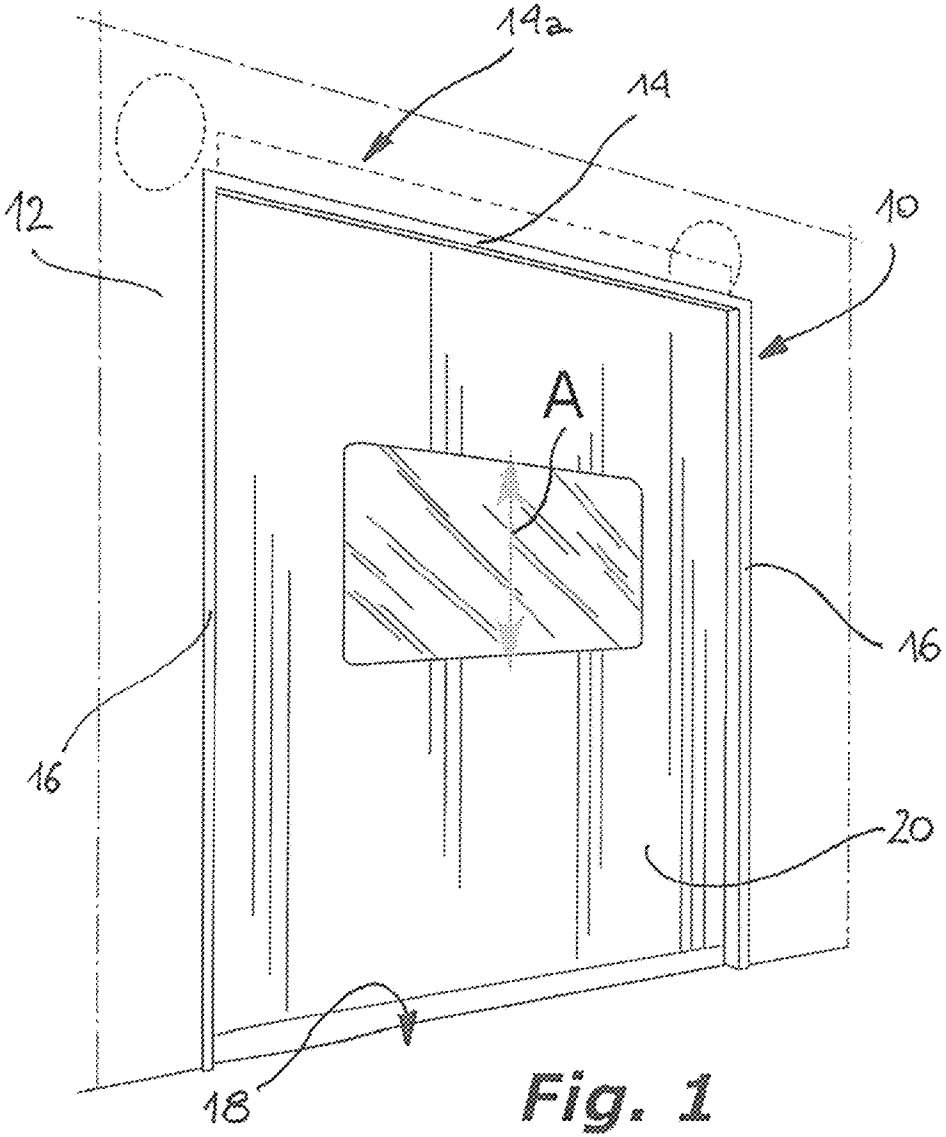
FIG. 1 is a schematic perspective view of a roll-up door comprising a curtain according to the invention.

With initial reference to FIG. 1, a vertical sliding roll-up door comprises a portal structure 10 which defines a generally rectangular opening of a wall 12, delimited by an upper cross member 14, by a pair of parallel vertical uprights 16 and by a lower base plane 18. The opening of the portal structure 10 can be closed by means of a flexible curtain 20, which is mounted vertically slidable with respect to the structure 10. Commonly, the curtain 20 is made of a plastic material such as PVC, polyethylene or polyurethane, or of a plasticized textile material, and has a thickness of the order of millimeter or a few millimeters.

Above the portal structure 10 there is provided a shelter room 14*a* of the curtain 20 in its raised condition corresponding to the open condition of the door.

Each guide rail 22 is shaped as a fork-shaped section with a pair of parallel branches between which a longitudinal cavity 23 is defined.

A continuous series of blocks 26 is connected to each lateral edge of the curtain 20, which slidably engage the cavities 23 of the respective guide rails 22 the cross section of which substantially corresponds to the profile of said cavities 23, apart from the presence of a small clearance to allow the blocks 26 to slide in the cavities 23.

The blocks 26 are shaped in a manner similar to the teeth of a half-part of a zip fastener, and have a thickness of the order of centimeter, so that they project from opposite sides with respect to the plane of the curtain 20. The series of blocks 26 is in particular fixed to a flexible strip-like portion 24 of textile material, in turn connected by means of a seam or welding to a respective lateral edge of the curtain 20.

FIGS. 4 to 7 of the drawings show two modifications of the curtain 20 of the present invention.

Figure 5:
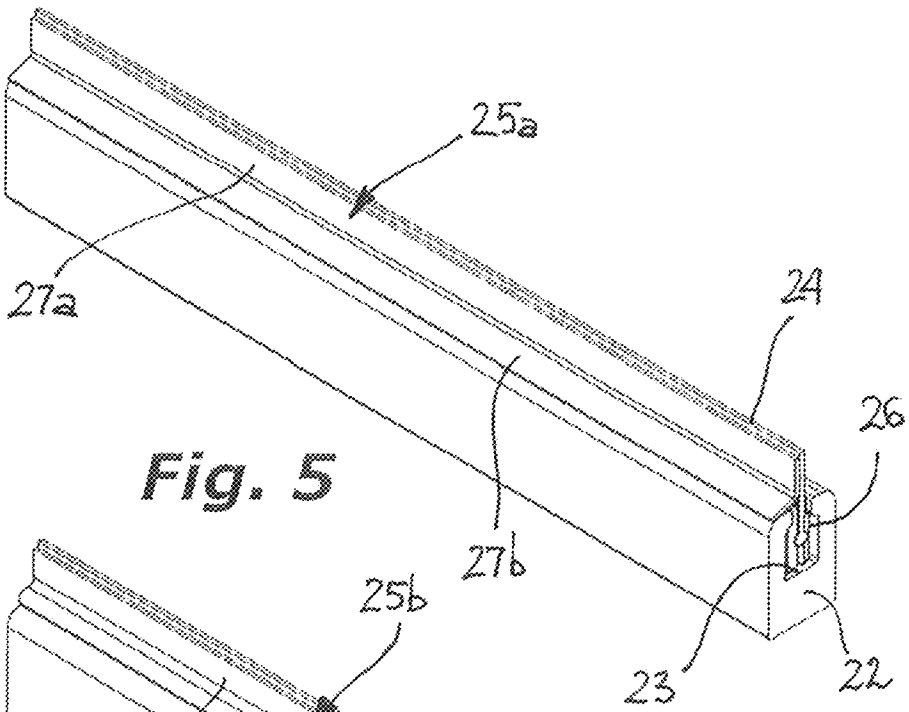
FIG. 5 is a perspective view of a section of a guide rail with a respective portion of the curtain according to the first modification of the invention.
Figure 4:
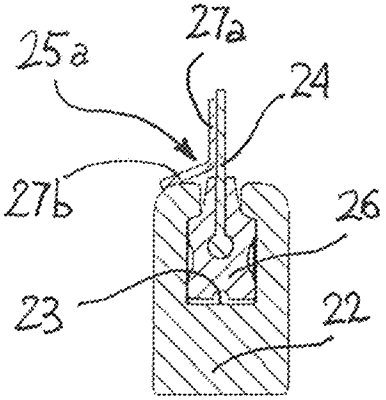
FIG. 4 is a cross-sectioned elevational view of a detail of a first modification of the curtain of the invention.

According to a first modification shown in FIGS. 4 and 5, at least one strip-like gasket 25*a* of laminar shape is associated with each lateral edge of the curtain 20 and extends along the entire length of the respective longitudinal edge of the curtain 20 where the blocks 26 are present.

Each gasket 25*a*, which is made of an elastic material, for example an elastomeric material or the like such as a foam of such material, is preferably fixed to the respective strip portion 24, and it is made in the form of a flat thin sheet comprising a first portion 27*a* for fixing to the strip 24 and a second portion 27*b* for resting on an outer surface of the respective guide rail 22, for example on an outer surface of one of the parallel branches of the rail 22.

In order to ensure the second portion 27*b* to rest on the surface of the respective rail 22, it projects from the plane 20 of the curtain according to an arrangement inclined and deformed with respect to its plane shape with which it was originally formed. The deformed configuration of use of this second portion 27*b*, which allows it to rest on the outer surface of the rail 22, gives rise to an elastic return force of the portion 27*b* toward its undeformed flat condition, which keeps it adherent to the respective guide rail 22.

In this manner, the portion 27*b* of each gasket 25*a* is arranged at a slot connected to the cavity 23 of the guide rail 22 and with the clearance between the blocks 26 and the cavity 23 of the corresponding guide rail 22, to prevent air from passing through this slot.

Conveniently, and according to a configuration not shown, a pair of gaskets 25*a* are associated with each edge of the curtain 20, on both sides of the curtain 20, so that each of them closes, on opposite sides of the curtain 20, a respective slot connected to the clearance between the blocks 26 and the inner profile of the cavity of the respective guide rail 22. This makes it possible to contrast even more effectively the passage of air between the blocks 26 and the cavity 23 of the guide rails 22.

According to another modification shown in FIGS. 6 and 7, for which only the differences with respect to the previous modification will be described in detail, each lateral edge of the curtain 20 has at least one strip-like gasket 25*b* which extends along the entire length of the respective longitudinal edge of the curtain 20, at the blocks 26.

Each gasket 25*b* comprises a first laminar portion 27*a* for fixing to the strip 24, and a second portion 27*c* whose end opposite to the first portion 27*a* is considerably thicker than the first portion 27*a*.

According to a configuration not shown in the drawings, the second portion 27*c* has a solid cross-section having an approximately square or rectangular cross-section.

Figure 7:
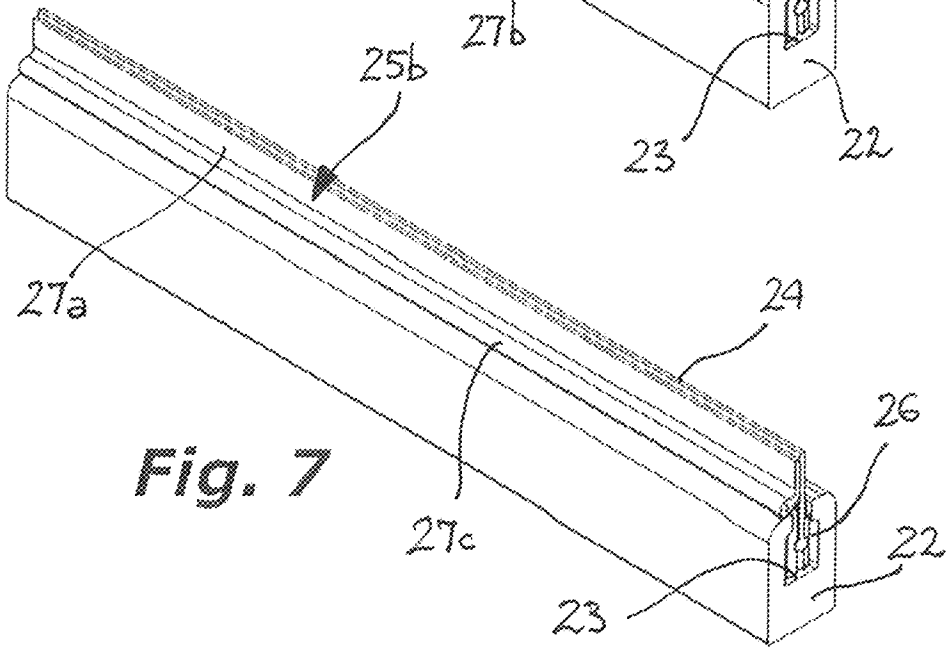
FIG. 7 is a view similar to FIG. 5 showing a section of guide rail with a respective portion of the curtain according to the second modification of the invention.
Figure 6:
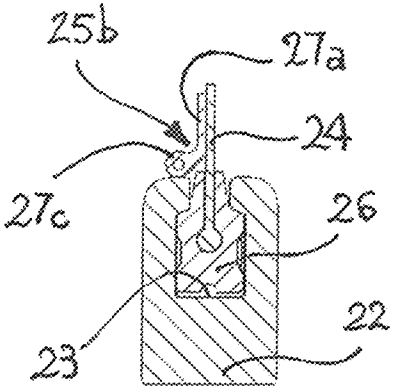
FIG. 6 is a view similar to FIG. 4 of a detail of a second modification of the curtain of the invention.

In the configuration shown in FIGS. 6 and 7, the second portion 27*c* has a tubular shape with an inner cylindrical cavity, by virtue of which the gasket 25*b* can be easily deformed by pressure, which allows it to be adapted to possible irregularities of the outer surface of the rails 22, and allows a greater strength of the end of said gasket 25*b* opposite its first portion 27*a*.

Also in this case, the gasket 25*b* is originally made in the flat form, with a material similar to that of the gasket 25*a* of the previous modification.

The resting of the second portion 27*c* on an outer surface of the respective rail 22 requires its deformation with respect to the original flat shape and to the first portion 27*a*, which generates an elastic return force which retains the second portion 27*c* adhering to the respective guide rail 22, so as to prevent air from flowing into the clearance between the blocks 26 and the cavity of the guide rails 22.

As for the previous modification, and according to a configuration not shown, each edge of the curtain 20 is conveniently provided with a pair of gaskets 25*b* each arranged on a respective side of the curtain 20, in order to contrast even more effectively the passage of air between the blocks 26 and the cavity 23 of the guide rails 22.

What is claimed is:

1. A curtain of a vertical sliding roll-up door, the door comprising a portal structure including vertical uprights provided with guide rails to guide a sliding of blocks fixed along lateral edges of the curtain, in order to allow the curtain to move vertically with respect to the portal structure, wherein the curtain is provided with air-sealing gaskets that extend substantially over the entire length of the lateral edges of the curtain at said blocks, in order to block passage of air between the guide rails and said blocks, said gaskets having a first portion fixed to one or more of the lateral edges of the curtain, or to a strip for fixing said gaskets to the curtain, and a second portion that projects from a plane of the curtain, which is configured to rest slidably on an outer surface of the respective guide rail, wherein said gaskets are formed of an elastic material in a flat form, whereby said second portion, in its configuration of use resting on an outer surface of the respective guide rail, takes on a deformed shape with respect to a flat shape, such as to create an elastic return force that keeps the second portion close to the respective guide rail.

2. The curtain of 1, wherein the curtain includes said gaskets on both sides of each of the lateral edges of the curtain.

3. The curtain of claim 1, wherein each of said gaskets comprises a strip of an elastomeric material, such as a foam of said elastomeric material.

4. The curtain of claim 1, wherein each of said gaskets is fixed to a flexible strip to which said blocks are connected, the curtain being fixed to this strip by sewing or welding.

5. The curtain of claim 1, wherein the second portion of each of the gaskets has a laminar shape.

6. The curtain of claim 1, wherein an end of said second portion of each of the gaskets is thicker than the first portion.

7. The curtain of claim 6, wherein said second portion of each of the gaskets has a tubular shape.

8. The curtain of claim 2, wherein each of said gaskets comprises a strip of an elastomeric material, such as a foam of said elastomeric material.

9. The curtain of claim 2, wherein each of said gaskets is fixed to a flexible strip to which said blocks are connected, the curtain being fixed to this strip by sewing or welding.

10. The curtain of claim 2, wherein the second portion of each of the gaskets has a laminar shape.

11. The curtain of claim 2, wherein the end of said second portion of each of the gaskets is thicker than the first portion.

12. The curtain of claim 11, wherein said second portion of each of the gaskets has a tubular shape.

13. The curtain of claim 1, wherein the second portion of each of the gaskets has a laminar shape.

14. A curtain of a vertical sliding roll-up door, the door comprising a portal structure including vertical uprights provided with guide rails to guide a sliding of blocks fixed along lateral edges of the curtain, in order to allow the curtain to move vertically with respect to the portal structure, wherein the curtain is provided with air-sealing gaskets that extend substantially over the entire length of the lateral edges of the curtain at said blocks, in order to block passage of air between the guide rails and said blocks, wherein each of the gaskets has a first portion and a second portion, wherein an end of the second portion of each of the gaskets is thicker than the first portion, and wherein said second portion of each of the gaskets has a tubular shape.

15. The curtain of claim 14, wherein the curtain includes said gaskets on both sides of each of the lateral edges of the curtain.

16. The curtain of claim 14, wherein the first portion of said gaskets is fixed to one or more of the lateral edges of the curtain, or to a strip for fixing said gaskets to the curtain, and the second portion that projects from a plane of the curtain and is configured to rest slidably on an outer surface of the respective guide rail.

17. The curtain of claim 16, wherein said gaskets are formed of an elastic material in a flat form, whereby said second portion, in its configuration of use resting on an outer surface of the respective guide rail, takes on a deformed shape with respect to a flat shape, such as to create an elastic return force that keeps the second portion close to the respective guide rail.

18. The curtain of claim 14, wherein each of said gaskets comprises a strip of an elastomeric material, such as a foam of said elastomeric material.

19. The curtain of claim 14, wherein each of said gaskets is fixed to a flexible strip to which said blocks are connected, the curtain being fixed to this strip by sewing or welding.

* * * * *